US007360654B2

(12) United States Patent
Liu

(10) Patent No.: US 7,360,654 B2
(45) Date of Patent: Apr. 22, 2008

(54) OPENER BOX

(76) Inventor: Kuo-Chen Liu, 235 Chung-Ho Box 8-24, Taipei (TW)

( * ) Notice: Subject to any disclaimer, the term of this patent is extended or adjusted under 35 U.S.C. 154(b) by 505 days.

(21) Appl. No.: 11/006,222

(22) Filed: Dec. 7, 2004

(65) Prior Publication Data

US 2006/0118446 A1 Jun. 8, 2006

(51) Int. Cl.
*B65D 85/28* (2006.01)

(52) U.S. Cl. ..... 206/754; 206/372; 206/379

(58) Field of Classification Search ..... 206/751, 206/752, 754, 756, 774, 372, 373, 379, 375
See application file for complete search history.

(56) References Cited

U.S. PATENT DOCUMENTS 6,050,409 A * 4/2000 Delbeck et al. ..... 206/375
6,615,983 B1 * 9/2003 Yu ..... 206/372
6,988,616 B2 * 1/2006 Chen ..... 206/379

* cited by examiner

*Primary Examiner*—Jacob K. Ackun, Jr.

(57) ABSTRACT

An opener box comprises a seat; a receiving box formed at a front end of the seat; the receiving box being openable; a rear side of the seat formed with a receiving section; a rear end of the receiving section being installed with a plurality of protrusions; each protrusion having a cambered side; a receiving frame for receiving opener heads; the receiving frame being formed with a plurality of receiving cylinders; each receiving cylinder having a hollow structure and two ends of the receiving cylinder having two openings; a lower side of each receiving cylinder having a slit; the receiving frame can be pivotally installed to the seat; a rear side of the receiving cylinder being enlarged for receiving a plurality of retaining seat; the retaining seat being slidably installed into a rear end of a respective one of the receiving cylinders.

3 Claims, 5 Drawing Sheets

OPENER BOX

FIELD OF THE INVENTION

The present invention relates to opener boxes, and in particular a opener box with a compact structure so that the openers can be stored firmly and taken out easily so as to increase the operation efficiency.

BACKGROUND OF THE INVENTION

The opener box serves to place openers, however in the prior art, the opener heads exposes out and is not fixed firmly so that the opener heads easily fall out. Although the prior art opener box can be used as a handle, all the opener heads must be taken out for the operation. This is very inconvenient. Furthermore, after operation, all the openers must be returned. This makes the user feel uneasy. Thereby it is very possible that the openers will lose. Furthermore, the opener box has a cover. Thereby in the operation, the cover must be uncovered and then placed aside. This is tedious and it is possible that the cover is lost.

SUMMARY OF THE INVENTION

Accordingly, the primary object of the present invention is to provide an opener boxes, and in particular an opener box with a compact structure so that the openers can be stored firmly and taken out easily so as to increase the operation efficiency.

To achieve above objects, the present invention provides an opener box comprises a seat; a receiving box formed at a front end of the seat; the receiving box being openable; a rear side of the seat formed with a receiving section; a rear end of the receiving section being installed with a plurality of protrusions; each protrusion having a cambered side; a receiving frame for receiving opener heads; the receiving frame being formed with a plurality of receiving cylinders; each receiving cylinder having a hollow structure and two ends of the receiving cylinder having two openings; a lower side of each receiving cylinder having a slit; the receiving frame can be pivotally installed to the seat; a rear side of the receiving cylinder being enlarged for receiving a plurality of retaining seat; the retaining seat being slidably installed into a rear end of a respective one of the receiving cylinders.

The various objects and advantages of the present invention will be more readily understood from the following detailed description when read in conjunction with the appended drawing.

DETAILED DESCRIPTION OF THE INVENTION

Figure 1:
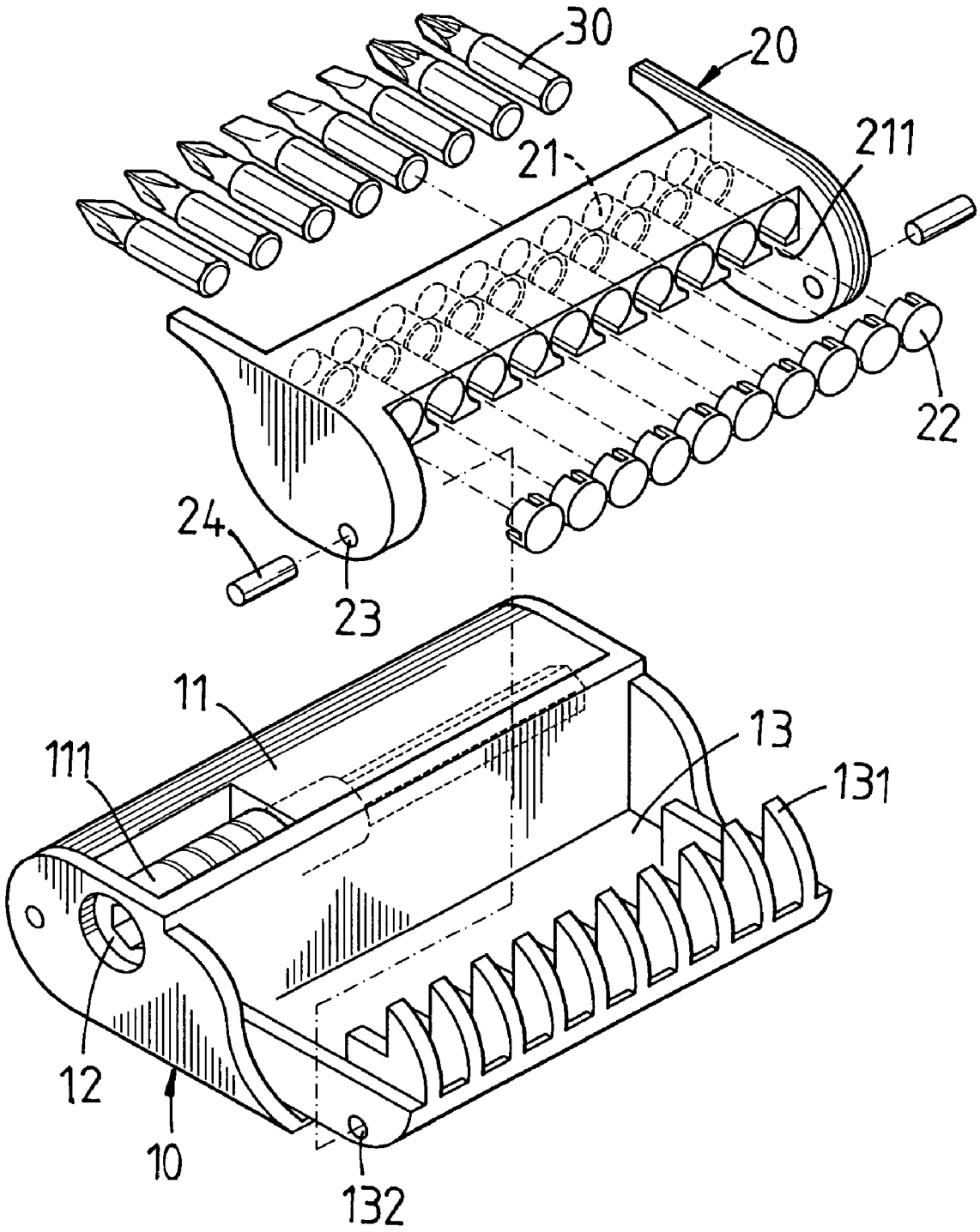
FIG. 1 is an exploded schematic view about the opener head of the present invention.
Figure 2:
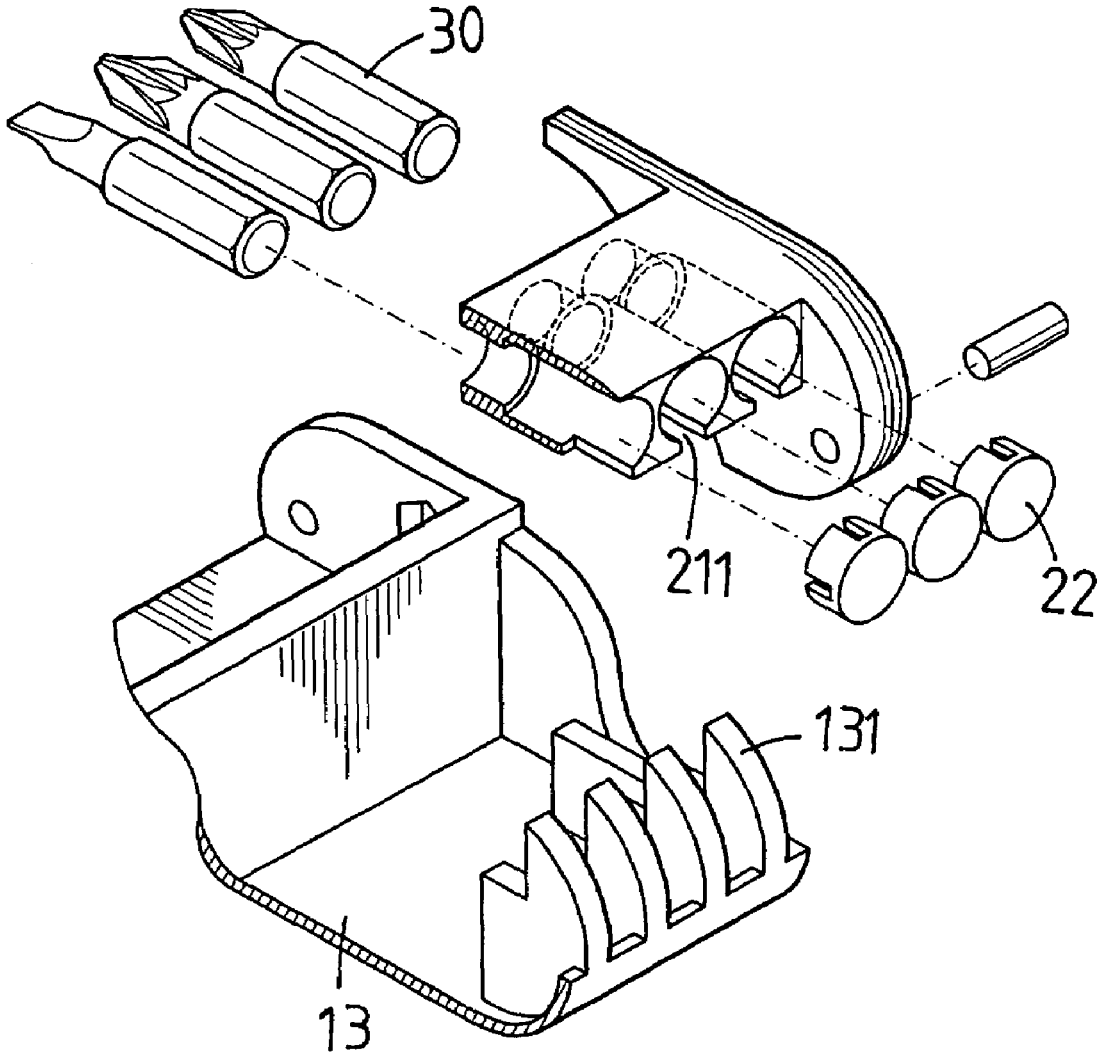
FIG. 2 is a partial exploded schematic view about the opener head of the present invention.
Figure 3:
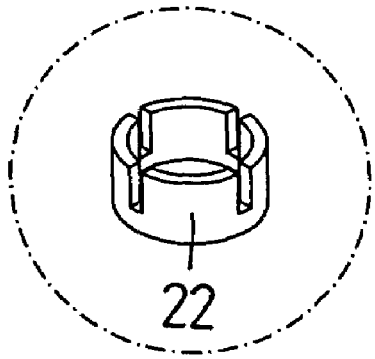
FIG. 3 is an enlarged schematic view about the retaining seat of the opener head of the present invention.
Figure 4:
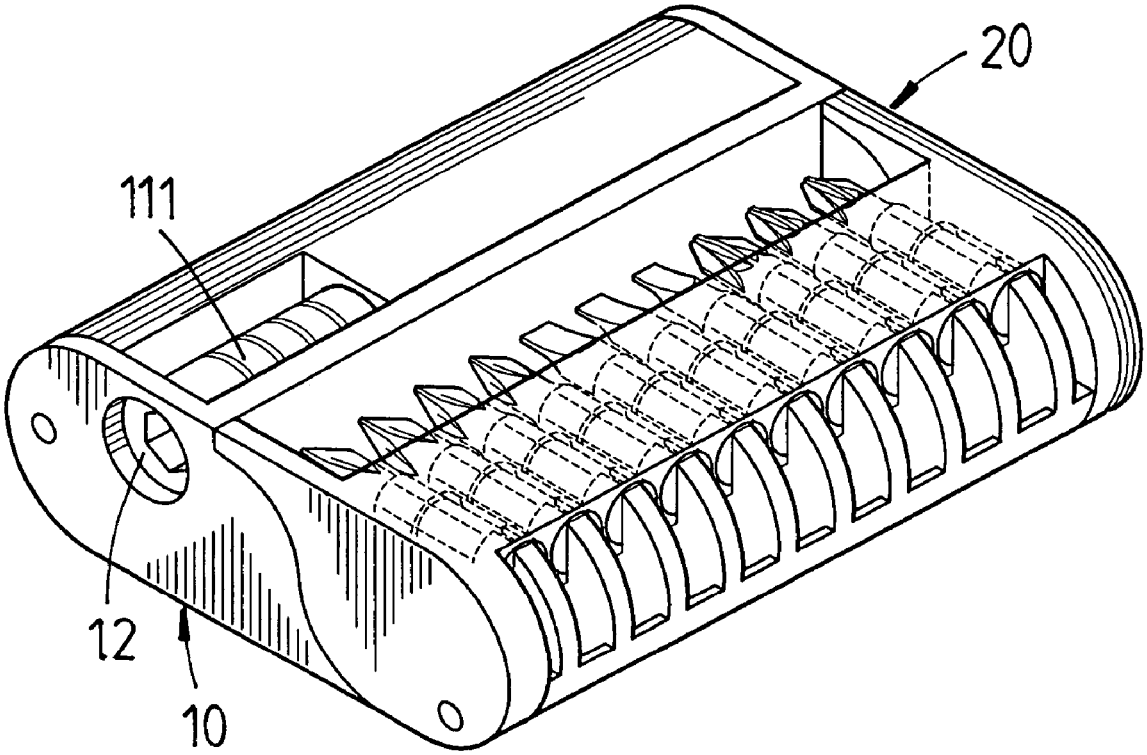
FIG. 4 is a schematic view about the assembly of the opener head of the present invention.

In order that those skilled in the art can further understand the present invention, a description will be described in the following in details. However, these descriptions and the appended drawings are only used to cause those skilled in the art to understand the objects, features, and characteristics of the present invention, but not to be used to confine the scope and spirit of the present invention defined in the appended claims.

With reference to FIGS. 1 to 4, the opener box of the present invention is illustrated. The opener box has the following elements.

A seat 10 is included. A receiving box 11 is formed at a front end of the seat 10. The receiving box 11 is openable for receiving a connecting rod 111. The connecting rod 111 has a joint (not shown) for receiving an opener head 30. One lateral side of the seat 10 is formed with an inserting hole 12. Thereby the opener head 30 can be inserted into the connecting rod 111. Then, the joint is inserted into the inserting hole 12 of the seat 10 so that the opener box of the present invention is formed as a screwing tool (this is known in the prior art, and thus the details will not be described herein). A rear side of the seat 10 is formed with a receiving section 13. One end of the receiving section 13 is installed with a plurality of protrusions 131. Each protrusion 131 has a cambered side. A lower section of each of two sides of the receiving section 13 is formed with a pivotal hole 132.

A receiving frame 20 is pivotally installed to the pivotal holes 132 of the receiving section 13. The receiving frame 20 serves for receiving opener heads 30. The receiving frame 20 is formed with a plurality of receiving cylinders 21. Each receiving cylinder 21 is a hollow structure and is opened at two ends. A lower side of each receiving cylinder 21 has a slit 211 corresponding to a respective one of the protrusions 131. A rear side of each receiving cylinder 21 is enlarged for receiving a respective retaining seat 22. A front end of each receiving cylinder 21 is reduced for receiving an opener head 30. When the retaining seat 22 is placed into the receiving cylinder 21, it is slidable within the receiving cylinder 21. A size of the retaining seat 22 is greater than that of the front end of the receiving cylinder 21. Thus the retaining seat 22 will not slide into the front end of the receiving cylinder 21. When the opener head 30 inserts into the front end of the receiving cylinder 21, it is clamped by the retaining seat 22 so that the opener head 30 will not fall out. Each of the two sides of the receiving frame 20 has a respective via hole 23 corresponding to the pivotal hole 132 of the seat 10. The receiving frame 20 can be pivotally installed to the seat 10 by using shafts 24 to insert through the pivotal holes 132 and the via holes 23.

In assembly of the present invention, the retaining seat 22 is firstly placed the rear end of the receiving cylinder 21 of the receiving frame 20. Then via holes 23 at two sides of the receiving frame 20 are aligned to the pivotal holes 132 of the receiving section 13. Then the shafts 24 are used to pivotally combine the receiving frame 20 and the seat 10. Thereby the receiving frame 20 is turnabe along the shaft 24. The retaining seat 22 is confined at the rear end of the receiving cylinder 21. The opener heads 30 are inserted from the front end of the receiving cylinder 21 so as to be fixed to the retaining seat 22 at the rear end of the receiving cylinder 21. Thereby the assembly of the present invention is completed.

Figure 5:
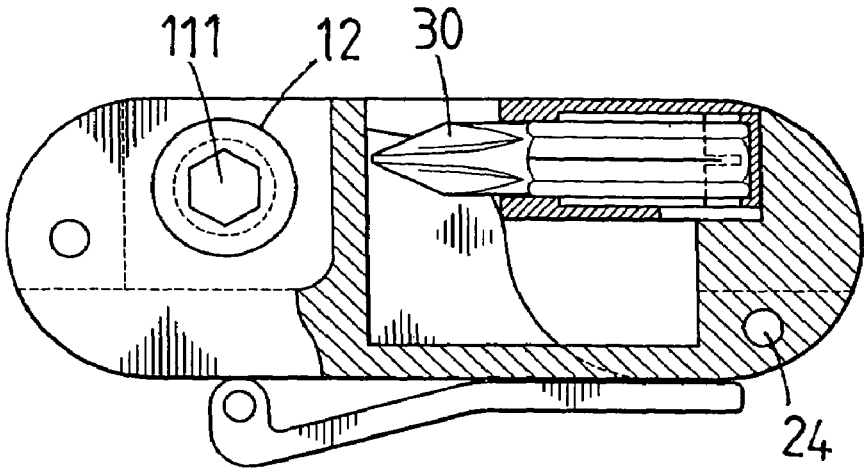
FIG. 5 is a cross sectional view about the opener head of the present invention, where the receiving frame is closed.

Referring to FIGS. 5 to 8, when the receiving frame 20 is closed, see FIG. 5, the opener heads 30 serve to push the retaining seat 22 to the rearmost of the receiving cylinder 21.

Figure 6:
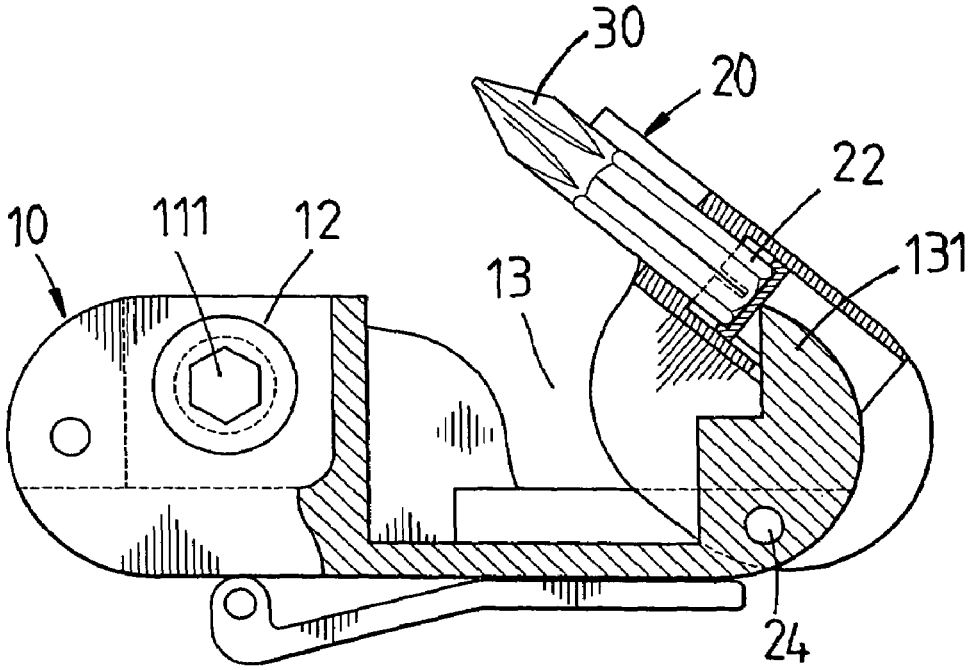
FIG. 6 is a cross sectional view about the opener head of the present invention, where the receiving frame is opened.
Figure 7:
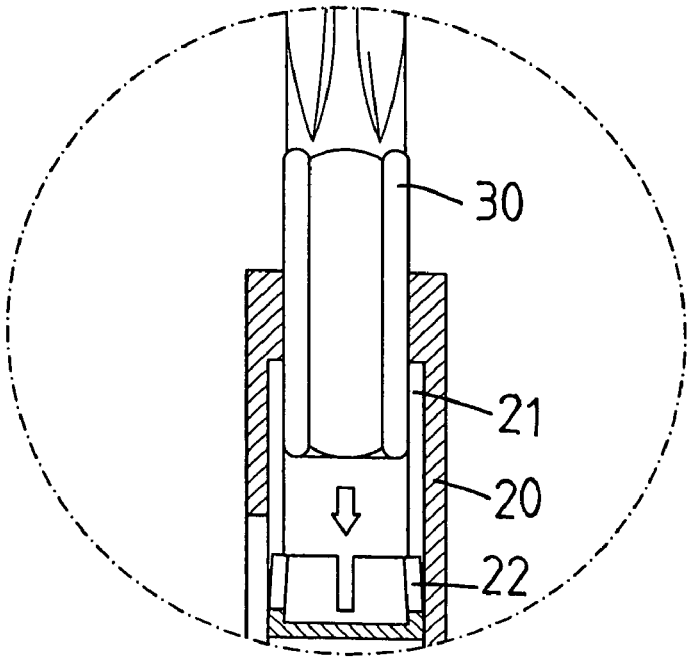
FIGS. 7 and 8 are schematic view about the opener head of the present invention, where the opener head is combined to the retaining seat.
Figure 8:
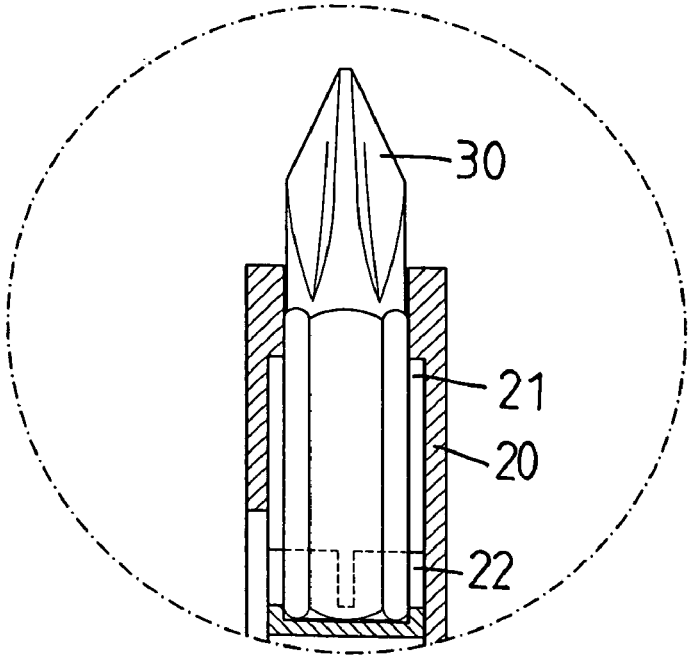

When the receiving frame 20 is opened, the protrusions 131 of the seat 10 will push forwards from the rear end of the receiving cylinder 21 of the receiving frame 20, as shown in FIG. 6, so that the retaining seat 22 and the opener heads 30 are pushed out. Thus, the user can take out the opener heads 30 conveniently. Furthermore, since the opener heads 30 are clamped by the retaining seat 22, they do not fall out. The user only applies a slight force for taking the opener head 30 out of the retaining seat 22. When desire to return the opener head 30, it is only to use a slight force to insert the opener head 30 into the retaining seat 22 at the rear end of the receiving cylinder 21.

In the present invention, not only a connecting rod 111 serves for receiving the opener heads 30. When storing the opener heads 30, the receiving frame 20 can be turn out so that the opener head 30 pushes the protrusions 131 so that the user can take the opener head 30 easily. Thereby the opener heads 30 will not fall out. Thereby the present invention is a convenient design.

The present invention is thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An opener box comprising:

a seat;

a receiving box formed at a front end of the seat; the receiving box being openable;

a rear side of the seat formed with a receiving section; a rear end of the receiving section being installed with a plurality of protrusions; each protrusion having a cambered side;

a receiving frame for receiving opener heads; the receiving frame being formed with a plurality of receiving cylinders; each receiving cylinder having a hollow structure and two ends of the receiving cylinder having two openings; a lower side of each receiving cylinder having a slit; the receiving frame being pivotally installed to the seat;

a rear side of the receiving cylinder being enlarged for receiving one of a plurality of retaining seats; each of the retaining seats being slidably installed into a rear end of a respective one of the receiving cylinders; wherein when the opener head inserts into the front end of the receiving cylinder, it is clamped by the retaining seat so that the opener head will not fall out; when the receiving frame is turned upwards, the protrusions will eject the opener heads upwards for taking the opener heads and wherein a size of a front end of the receiving cylinder is smaller than that of a rear of the receiving cylinder 21;

wherein a front end of the seat is installed with a receiving box for receiving a connecting rod 111; one side of the seat has an inserting hole; a connecting rod is able to be inserted into the inserting hole; and the connecting rod 111 is capable of being connected to an opener head so as to be as a screw means.

2. The opener box as claimed in claim 1, wherein two sides of a rear end of the seat have respective pivotal holes and two sides of the receiving frame have respective via holes; shafts are inserted into the pivotal holes and the via holes so as to fix the receiving frame to the seat.

3. The opener box as claimed in claim 1, wherein each protrusion has a cambered side.

* * * * *